United States Patent [19]

Kato et al.

[11] Patent Number: 4,929,527

[45] Date of Patent: May 29, 1990

[54] METHOD OF IMAGE FORMATION WHICH INCLUDES SCANNING EXPOSURE PROCESS

[75] Inventors: Eiichi Kato; Shigeru Ohno; Kazuo Ishii; Ryosuke Itakura, all of Shizuoka, Japan

[73] Assignee: Fuji Photo Film Co., Ltd., Kanagawa, Japan

[21] Appl. No.: 185,181

[22] Filed: Apr. 22, 1988

[30] Foreign Application Priority Data

Apr. 22, 1987 [JP] Japan ..... 62-97523

[51] Int. Cl.[5] ..... G03G 5/09; G03G 13/22

[52] U.S. Cl. ..... 430/92; 430/93; 430/95

[58] Field of Search ..... 430/92, 93, 95

[56] References Cited

U.S. PATENT DOCUMENTS

| | | | |
|---|---|---|---|
| 3,660,085 | 5/1972 | Depoorter et al. | 430/93 |
| 3,682,630 | 8/1972 | Park | 430/93 |
| 3,881,926 | 5/1975 | Öhlschlager et al. | 430/78 |
| 3,923,507 | 12/1975 | Öhlschlager et al. | 430/78 |
| 4,040,825 | 8/1977 | Steiger et al. | 430/95 |
| 4,362,800 | 12/1982 | Takimoto et al. | 430/83 |
| 4,418,135 | 11/1983 | Beeson et al. | 430/93 |
| 4,565,757 | 1/1986 | Chalk et al. | 430/95 |

FOREIGN PATENT DOCUMENTS

| | | | |
|---|---|---|---|
| 4632719 | 12/1965 | Japan | 430/95 |
| 58-42051 | 3/1983 | Japan | 430/93 |
| 59-22053 | 2/1984 | Japan | 430/92 |
| 885717 | 12/1961 | United Kingdom | 430/93 |

*Primary Examiner*—Roland E. Martin
*Assistant Examiner*—Jeffrey A. Lindeman
*Attorney, Agent, or Firm*—Sughrue, Mion, Zinn, Macpeak & Seas

[57] ABSTRACT

A photoconductive composition which exhibits excellent dark reduction retention, excellent sensitivity to radiation from the near infrared region to the infrared region as well as excellent long-term stability, is comprised of an inorganic photoconductor, a cyclic acid anhydride and a spectral sensitizing dye dispersed in a binding resin. A laser beam scanning exposure can be performed on said composition to produce electrophotographic images.

9 Claims, No Drawings

METHOD OF IMAGE FORMATION WHICH INCLUDES SCANNING EXPOSURE PROCESS

FIELD OF THE INVENTION

This invention relates to a method of image formation which includes a scanning exposure process. More particularly, it relates to a method of image formation which includes a scanning exposure process in which use is made of a photoconductive composition, said composition comprising an inorganic photoconductor which has good dark charge-retaining properties and which has been spectrally sensitized to radiation from the near infrared region to the infrared region by a spectral sensitizing dye, and a cyclic acid anhydride dispersed in a binding resin. The invention also relates to electrophotographic recording systems.

BACKGROUND OF THE INVENTION

Recording systems in which a laser beam is used, which is to say laser beam recording systems, exist for electrophotographic recording purposes. In these systems a recording is made by focusing the laser light emerging from a laser with an $f\theta$ lens, forming a scanning image on a photosensitive body by means of a polygonal mirror and developing and transcribing this image as required.

The development of photosensitive materials which are sensitive to the wavelength region about 700 nm has become desirable in recent years as a result of the development of low output semiconductor lasers (in practice, lasers which have an output of some 5 to 25 mW). The electrophotographic photosensitive materials used with semiconductor lasers of this type require various properties different from those of the conventional electrophotographic photosensitive materials. Thus, an adequate sensitivity to radiation from the near infrared region into the infrared region and good dark charge-retaining properties are especially important.

The use of various spectral sensitizing dyes in electrophotographic photosensitive layers comprising photoconductor-resin dispersion based photoconductive composition is known. For example, dyes for spectral sensitization to red light and infrared radiation have been disclosed in U.S. Pat. Nos. 3,619,154 and 3,682,630, but these dyes are easily degraded particularly during the storage of the dye or during the manufacture and storage of the electrophotographic photosensitive layer and so their performance is poor and this is greatly disadvantageous in practice. Harazaki et al. have stated that the sensitizing dyes for red light and infrared radiation are more unstable that the sensitizing dyes for light of shorter wavelengths (visible light) (*Industrial Chemistry Journal* (Japanese), Vol. 66, No. 2, page 26 (1963)).

Furthermore, cyanine dyes for spectral sensitization when zinc oxide is used as a photoconductor have been disclosed in Japanese Patent Application (OPI) Nos. 58554/83, 42055/83 and 59453/83 (the term "OPI" as used herein refers to a "published unexamined Japanese patent application"). However, these cyanine dyes do not extend into the near infrared and infrared wavelength regions nor are they sufficiently stable in the photosensitive body. Thus, in either case it is impossible to achieve a satisfactory level of sensitivity.

Electrophotographic photosensitive materials comprising photoconductive compositions which contain heptamethine cyanine dyes which have a 3,3-dialkylindole ring or a 3,3-dialkylbenzo[e]indole ring at both ends are disclosed in U.S. Pat. No. 4,362,800. The sensitized range of these photosensitive materials extends to 750 nm and above and they also have good stability.

However, there is a disadvantage in that these prior art electrophotographic photosensitive materials have inadequate dark charge-retaining properties. As mentioned above, the situation when a semiconductor laser is used as a light source differs from that in conventional full-surface exposure systems in which visible light is used, in that a scanning exposure system is used and the period beginning from the time at which the photosensitive material is charged until the exposure is completed is longer. The unexposed parts must retain their charge satisfactorily during this time. Thus, dark charge-retaining properties are a very important feature for electrophotographic photosensitive materials for use with scanning exposures.

Furthermore, the light sources have a low output and so a sufficiently high sensitivity in the near infrared to infrared region is required. The prior art electrophotographic photosensitive materials mentioned above are also inadequate in this respect.

SUMMARY OF THE INVENTION

An object of this invention is to provide a method of image formation which includes a process of scanning exposure with a laser beam using a photoconductive composition which has an adequate sensitivity to radiation in the near infrared to infrared region and which has superior dark charge-retaining properties.

The above mentioned object is achieved by means of a method of image formation comprising exposing a photoconductive body comprising a photoconductive composition to a scanning laser beam and developing the exposed photosensitive body, wherein the photoconductive composition comprises at least an inorganic photoconductor, a spectral sensitizing dye, a cyclic acid anhydride dispersed in a binding resin, wherein the spectral sensitizing dye is a compound containing at least one carboxyl group, sulfo group and/or phospho group represented by the general formula (I):

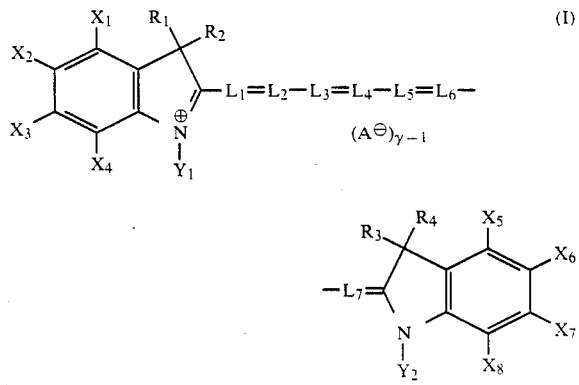

(I)

In formula (I), $R_1$, $R_2$, $R_3$ and $R_4$ may be the same or different and each represents an alkyl group.

$L_1$ to $L_7$ may be the same or different and each represents a substituted or unsubstituted methine group. The substituent group may be a halogen atom, a hydroxyl group, a carboxyl group, an alkyl group, an aralkyl group, an aryl group, an $—OR'_1$ group, an $—OCOR'_2$ group or a $—COOR'_3$ group (wherein $R'_1$, $R'_2$ and $R'_3$ each represents an alkyl group, an alkenyl group, an aralkyl group or an aryl group).

$X_1$ to $X_8$ may be the same or different and each represents a hydrogen atom, a carboxyl group, a sulfo group, a halogen atom, a nitro group, a cyano group, a substituted or unsubstituted alkyl group, a substituted or unsubstituted aralkyl group, a substituted or unsubstituted aryl group, an —O—$Z_1$ group (wherein $Z_1$ represents a substituted or unsubstituted aliphatic group, a substituted or unsubstituted aromatic group or a substituted or unsubstituted heterocyclic group), an —$OCOZ_2$ group (wherein $Z_2$ has the same meaning as $Z_1$), a —$COOZ_3$ group (wherein $Z_3$ has the same meaning as $Z_1$), a

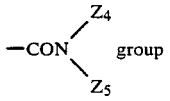

(wherein $Z_4$ and $Z_5$ may be the same or different and each represents a hydrogen atom, a substituted or unsubstituted aliphatic group, a substituted or unsubstituted aromatic group or together represent an organic group, which together with the adjacent atom, N, form a heterocyclic group), or an

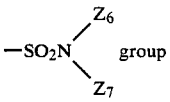

(wherein $Z_6$ and $Z_7$ have the same meaning as $Z_4$ and $Z_5$).

Furthermore, $X_5$ and $X_6$ may be connected to each other to form a benzene ring.

Moreover, at least one of $X_1$ to $X_8$ represents a group other than a hydrogen atom.

$Y_1$and $Y_2$ may be the same or different and each represents a substituted or unsubstituted alkyl group.

$A^{\ominus}$ represents an anion.

$\gamma$ represents 1 or 2, with the proviso that, when $Y_1$ and/or $Y_2$ contains a sulfo group or a phospho group, $\gamma$ is 1.

DETAILED DESCRIPTION OF THE INVENTION

Laser beam recording is normally carried out by focusing the laser light which emerges from a gas laser such as an He-Cd or He-Ne laser or a semiconductor laser such as a GaAlAs laser, etc., using an f$\theta$ lens, forming a scanning image on a photosensitive body by means of a polygonal mirror and developing and transcribing the image as required. When a gas laser is used, it is necessary to use a light modulator. Since a semiconductor laser is both smaller and lighter than a gas laser and has the advantage of not requiring the use of a modulator, semiconductor lasers are coming into greater use. However, the light from a practical GaAlAs semiconductor laser has an emitted wavelength of about 780 nm and so the photoconductive compositions which are used must be sensitive to laser light of this wavelength.

In laser beam scanning recording, the laser light is deflected by a rotating mirror. In the case of planar scanning, the scanning rate is a function of the deflection angle and strain appears in the copy so an f$\theta$ lens, etc., is used in the optical system to improve linearity. The reflecting surfaces of the polygonal mirror can be made with a curvature to make up for the scanning strain instead of using an f$\theta$ lens. Other systems can be adopted for the scanning system; for example, systems in which a mirror is moved in a parallel manner and systems in which a plurality of mirrors is used can be adopted.

Zinc oxide, titanium oxide, zinc sulfide, cadmium sulfide, zinc selenide, cadmium selenide, lead sulfide, etc., can be used as the inorganic photoconductor which is used in the method of image formation of this invention. Furthermore, these photoconductors may also be treated photoconductors as disclosed, for example, by H. Miyamoto and H. Takei in *Imaqing,* 1973 (No. 8).

The specific compounds represented by the general formula (I) useful in the present invention are such that $R_1$, $R_2$, $R_3$ and $R_4$ can be the same or different and each preferably represents an alkyl group which has from 1 to 4 carbon atoms (for example, a methyl group, an ethyl group, a propyl group or a butyl group).

$L_1$ to $L_7$ each represents a substituted or unsubstituted methine group. Suitable examples of substituent groups include, for example, a halogen atom (for example, a fluorine atom, a chlorine atom, a bromine atom, an iodine atom), a hydroxyl group, a carboxyl group, an alkyl group which has from 1 to 8 carbon atoms and which may be substituted (for example, a methyl group, an ethyl group, a propyl group, a butyl group, a hexyl group, an octyl group, a chloromethyl group, a hydroxymethyl group, a trifluoromethyl group, a methoxymethyl group, an ethoxymethyl group, a butoxymethyl group, etc.), an aralkyl group which has from 7 to 10 carbon atoms and which may be substituted (for example, a benzyl group, a phenethyl group, a chlorobenzyl group, a methoxybenzyl group, a methylbenzyl group, an ethoxybenzyl group, a phenoxybenzyl group, etc.), a phenyl group which may be substituted (for example, a phenyl group, a chlorophenyl group, a bromophenyl group, a dichlorophenyl group, a carboxyphenyl group, a methoxyphenyl group, a tolyl group, a xylyl group, an acetamidophenyl group, etc.), an $OR'_1$ group, an -$OCOR'_2$ group or a -$COOR'_3$ group wherein $R'_1$, $R'_2$ and $R'_3$ each preferably represents an alkyl group which has from 1 to 8 carbon atoms and which may be substituted (for example, a methyl group, an ethyl group, a propyl group, a butyl group, a hexyl group, a 2-chloroethyl group, a 2-bromoethyl group, a 2-methoxyethyl group, a 2-cyanoethyl group, a 3-methoxypropyl group, a 3-sulfopropyl group, a 4-sulfobutyl group, a carboxymethyl group, a 2-carboxyethyl group, a 3-carboxypropyl group, a 4-carboxybutyl group, a 2-ethoxycarbonylethyl group, a 3-hydroxypropyl group, etc.), an alkenyl group which has from 2 to 8 carbon atoms and which may be substituted (for example, a vinyl group, an allyl group, a 3-butenyl group, a 6-hexenyl group, a 2-pentenyl group, a 2-hexenyl group, an isoprene group, etc.), an aralkyl group which has from 7 to 12 carbon atoms and which may be substituted (for example, a benzyl group, a phenethyl group, a chlorobenzyl group, a dichlorobenzyl group, a methoxybenzyl group, a methylbenzyl group, a carboxybenzyl group, a sulfobenzyl group, etc.) or a phenyl group which may be substituted (for example, a phenyl group, a tolyl group, a xylyl group, a cumenyl group, a chlorophenyl group, a bromophenyl group, an indenyl group, a methoxyphenyl group, a dichlorophenyl group, a cyanophenyl group, a chloromethoxyphenyl group, an acetamidophenyl group, a chloromethylphenyl group, etc.).

$X_1$ to $X_8$ may be the same or different and each represents a hydrogen atom; a carboxyl group; a sulfo group; a halogen atom (for example, a fluorine atom, a chlorine atom, a bromine atom, etc.); a nitro group; a cyano group; an alkyl group which preferably has from 1 to 6 carbon atoms and which may be substituted (for example, a methyl group, an ethyl group, a propyl group, a butyl group, a hexyl group, a chloromethyl group, a trifluoromethyl group, a 2-methoxyethyl group, a 2-chloroethyl group, etc.); an aralkyl group which preferably has from 7 to 12 carbon atoms and which may be substituted (for example, a benzyl group, a phenethyl group, a chlorobenzyl group, a dichlorobenzyl group, a methoxybenzyl group, a methylbenzyl group, a dimethylbenzyl group, etc.); an aryl group which may be substituted (for example, a phenyl group, a naphthyl group, an indenyl group, a tolyl group, a xylyl group, a mesityl group, a chlorophenyl group, a dichlorophenyl group, an ethoxyphenyl group, a cyanophenyl group, an acetylphenyl group, a methanesulfonylphenyl group, etc.); an —O—$Z_1$ group, an —OCO$Z_2$ group or a —COO$Z_3$ group [wherein $Z_1$, $Z_2$ and $Z_3$ preferably have the same meaning as $R'_1$, $R'_2$ and $R'_3$, respectively, described above or each represents a heterocyclic group (for example, a thienyl group, a pyridyl group, an imidazolyl group, a chlorothienyl group, a pyrrole group, etc.)]; a

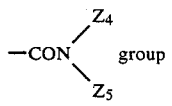

or an

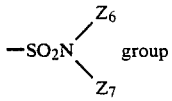

wherein $Z_4$, $Z_5$, $Z_6$ and $Z_7$ may be the same or different and each represents a hydrogen atom, an alkyl group which preferably has from 1 to 8 carbon atoms and which may be substituted (for example, a methyl group, an ethyl group, a propyl group, a butyl group, a hexyl group, an octyl group, a 2-chloroethyl group, a 3-chloropropyl group, a 3-hydroxypropyl group, a 2-bromoethyl group, a 2-hydroxyethyl group, a 2-sulfoethyl group, a 2-cyanoethyl group, a 2-methoxyethyl group, a 2-ethoxyethyl group, a 2-carboxyethyl group, a 3-hydroxypropyl group, a 4-hydroxypropyl group, a 2-(4-sulfobutyl)ethyl group, a 2-methanesulfonylethyl group, a 3-ethoxypropyl group, a 2,2,2-trifluoroethyl group, etc.), an alkenyl group which preferably has from 2 to 8 carbon atoms and which may be substituted (for example, a vinyl group, an allyl group, a 3-butenyl group, a 2-hexenyl group, a 6-hexenyl group, etc.), an aralkyl group which preferably has from 7 to 12 carbon atoms and which may be substituted (for example, a benzyl group, a phenethyl group, a chlorobenzyl group, a methylbenzyl group, a sulfobenzyl group, a carboxybenzyl group, a methoxycarbonylbenzyl group, an acetamidobenzyl group, a methoxybenzyl group, a dichlorobenzyl group, a cyanobenzyl group, a trimethylbenzyl group, etc.) or a phenyl group which may be substituted (for example, a phenyl group, a tolyl group, a xylyl group, a butylphenyl group, a chloromethylphenyl group, a methoxyphenyl group, an ethoxyphenyl group, a butoxyphenyl group, an acetamidophenyl group, a carboxyphenyl group, a sulfophenyl group, a trifluoromeothylphenyl group, a chloromethylphenyl group, etc.), or $Z_4$ and $Z_5$, or $Z_6$ and $Z_7$ together may be an organic group which together with the adjacent atom, N, form a heterocyclic group (for example, a piperazyl group, a piperidyl group, an indolinyl group, a morpholinyl group, an isoindolinyl group, etc.).

Moreover, at least one of $X_1$ to $X_8$ represents a group other than a hydrogen atom.

$Y_1$ and $Y_2$ may be the same or different and each preferably represents an alkyl group which has from 1 to 12 carbon, atoms and which may be substituted with groups other than a carboxyl group, a sulfo group or a phospho group (for example, a methyl group, an ethyl group, a propyl group, a butyl group, a pentyl group, a hexyl group, an octyl group, a decyl group, a dodecyl group, a benzyl group, a phenethyl group, an allyl group, a 2-hydroxyethyl group, a 3-hydroxypropyl group, a 6-hydroxyhexyl group, a 10-hydroxydecyl group, a 2-methoxyethyl group, a 2-ethoxyethyl group, a 3-cyanopropyl group, a methoxycarbonylmethyl group, a 3-ethoxycarbonylpropyl group, a 4-methoxycarbonylbutyl group, an N,N-dimethylaminoethyl group, an N-methyl-N-benzylaminopropyl group, a 2-acetoxyethyl group, a 2-propionyloxyethyl group, a 3-butyryloxypropyl group, etc.) or an alkyl group which has from 1 to 12 carbon atoms and which is substituted with at least one carboxyl group, sulfo group and/or phospho group and which may have other substituent groups (for example, a carboxymethyl group, a 2-carboxyethyl group, a 3-carboxypropyl group, a 4-carboxybutyl group, a 2-carboxypropyl group, a 2-carboxybutyl group, a 5-carboxyheptyl group, a 2-chloro-3-carboxypropyl group, a propyl group, a 2-(3'-carboxypropylcarbonyloxy)ethyl group, a 6-carboxyhexyl group, a 2'-carboxybenzyl group, a 4'-carboxybenzyl group, a 3-(2'-carboxyethylcarbonyloxy)propyl group, a 2-(2'-carboxyethylcarbamoyl)ethyl group, a 2-(2'-carboxyethyloxy)ethyl group, a 2-sulfoethyl group, a 3-sulfopropyl group, a 4-sulfobutyl group, a 2-(3'-sulfopropyloxy)ethyl group, a 2-(4'-sulfobutyloxy)ethyl group, a 3-(4'-sulfobutyloxy)propyl group, a 4-(o'-sulfobenzoyloxy)butyl group, a 5-sulfo-pentyl group, an 8-sulfooctyl group, a 10-sulfodecyl group, a 4-(4'-sulfobutyloxy)butyl group, a 6-(4'-sulfobutyloxy)hexyl group, a 2-(4'-sulfobutylamino)ethyl group, a 2'-sulfobenzyl group, a 4'-sulfobenzyl group, a 2-phosphoethyl group, a 2-phosphooxyethyl group, a 3-phosphooxypropyl group, a 4-phosphooxybutyl group, a 3-phosphooxybutyl group, a 6-phosphooxyhexyl group, a 4'-phosphobenzyl group, a 4'-phosphooxybenzyl group, etc.). Furthermore, these carboxyl groups, sulfo groups and phospho groups may take the form of a carbonate, sulfonate or phosphonate which is bonded to a cation. Alkali metal ions (for example, lithium ions, sodium ions, potassium ions, etc.) and alkaline earth metal ions (for example, magnesium ions, calcium ions, barium ions, etc.), etc., are preferred as the cation.

Moreover, the above carboxyl groups and sulfo groups may take the form of salts with organic bases (for example, pyridine, morpholine, N,N-dimethylaniline, triethylamine, pyrrolidine, piperidine, etc.).

A⊖ represents an anion such as a chlorine ion, a bromine ion, an iodine ion, a thiocyanate ion, a methyl sulfate ion, an ethyl sulfate ion, a benzenesulfonate ion, a p-toluenesulfonate ion, a perchlorate ion, a boron tetrabromide ion, etc.

Moreover, $\gamma$ represents 1 or 2. In cases where a sulfo group or a phospho group is included in said dye molecule, an intramolecular salt is formed and has a value of 1.

Furthermore, the compounds which can be represented by general formula (I) contain at least one carboxyl group, sulfo group and/or phospho group. Preferred compounds of formula (I) are those containing at least two groups selected from the carboxyl, sulfo and phospho groups, and more preferred compounds are those containing at least two sulfo groups.

Examples of compounds which are represented by general formula (I) useful in the invention are indicated below, but the range of such compounds is not limited to these examples.

Compound (1)

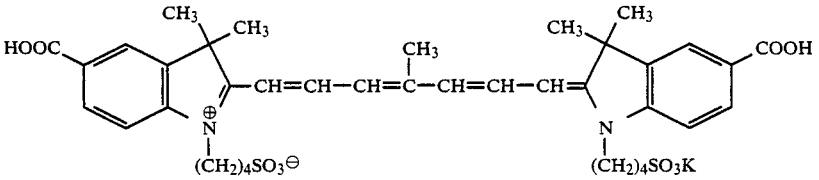

Compound (2)

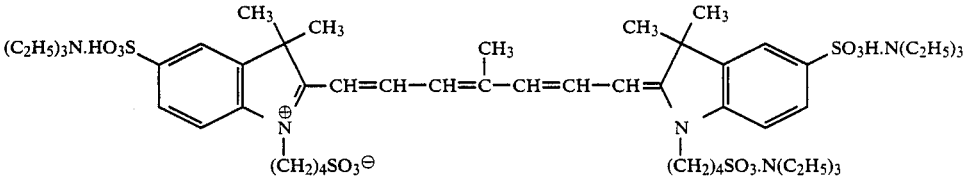

Compound (3)

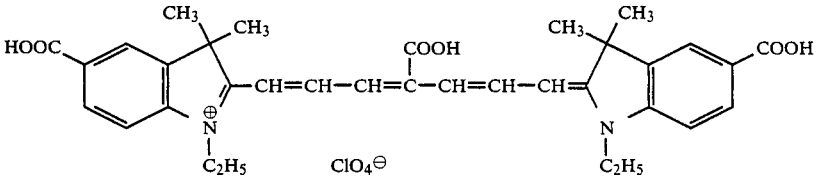

Compound (4)

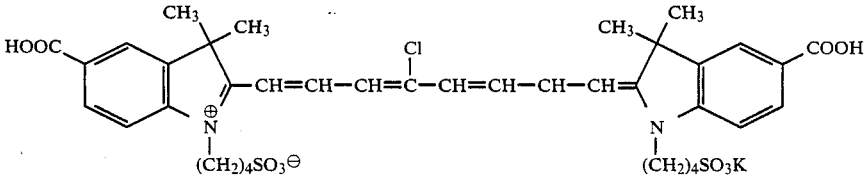

Compound (5)

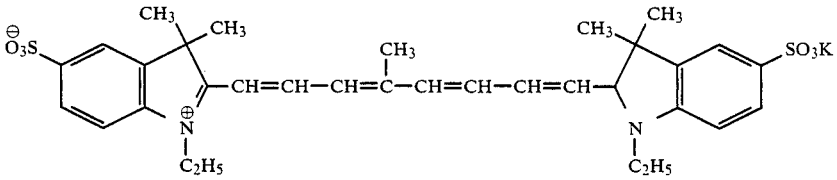

Compound (6)

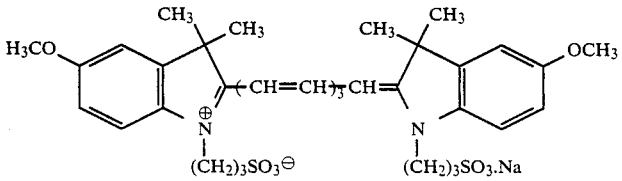

Compound (7)

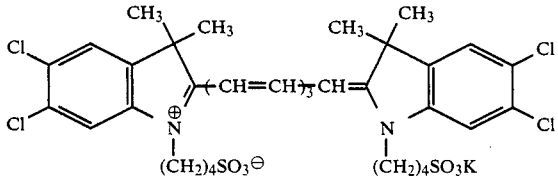

-continued
Compound (8)
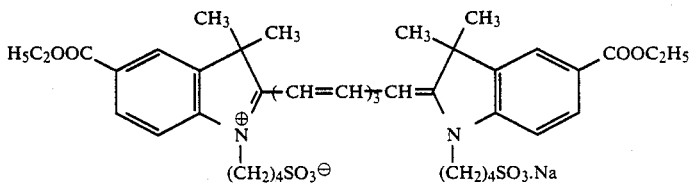
Compound (9)
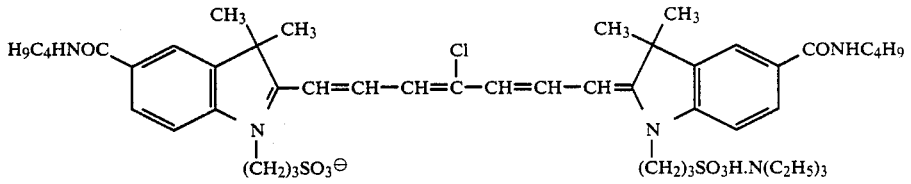
Compound (10)
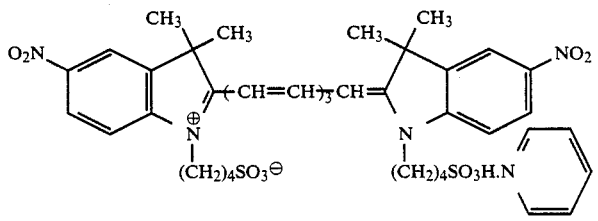
Compound (11)
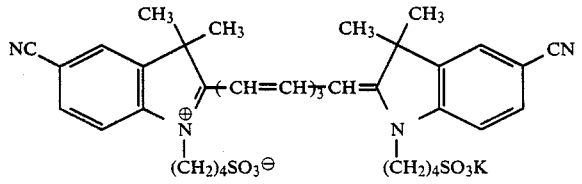
Compound (12)
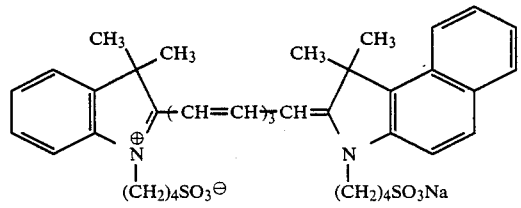
Compound (13)
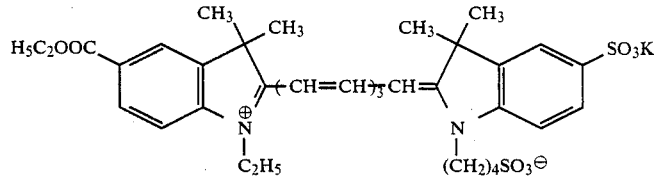
Compound (14)
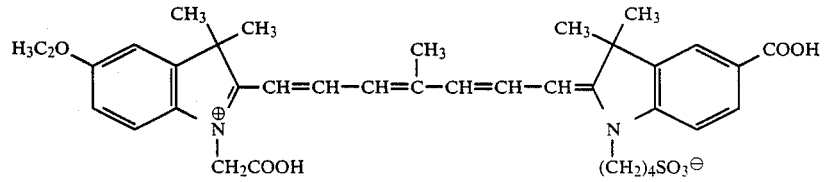
Compound (15)
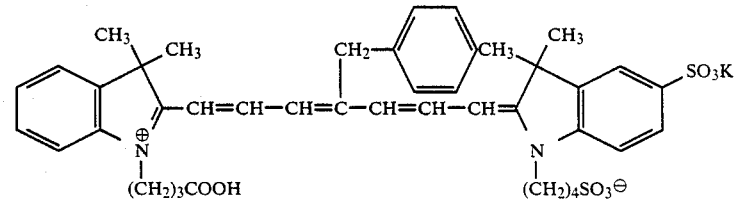

-continued
Compound (16)
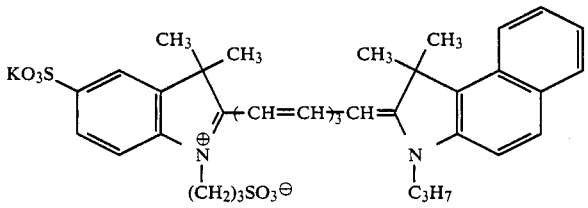
Compound (17)
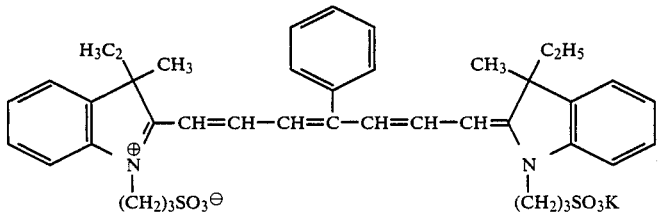
Compound (18)
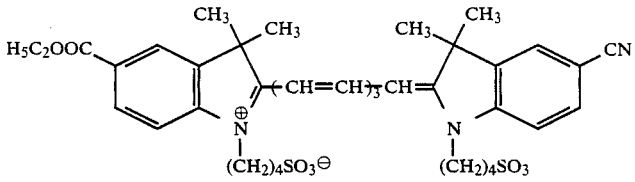
Compound (19)
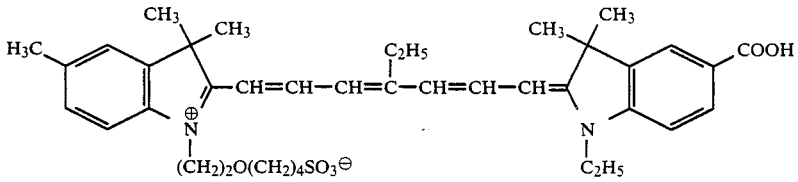
Compound (20)
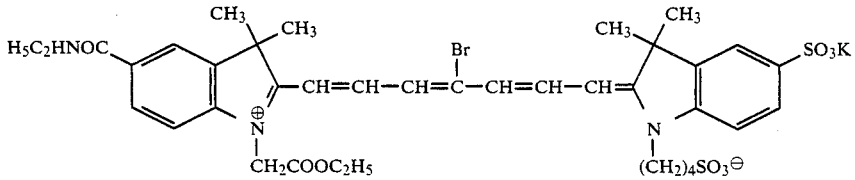
Compound (21)
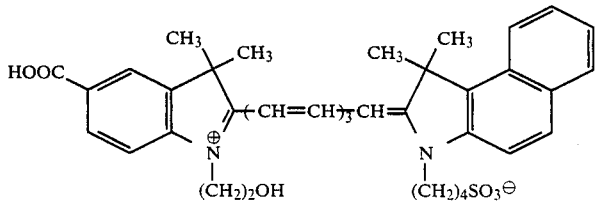
Compound (22)
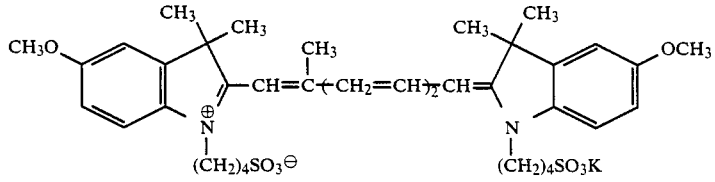

-continued

Compound (23)

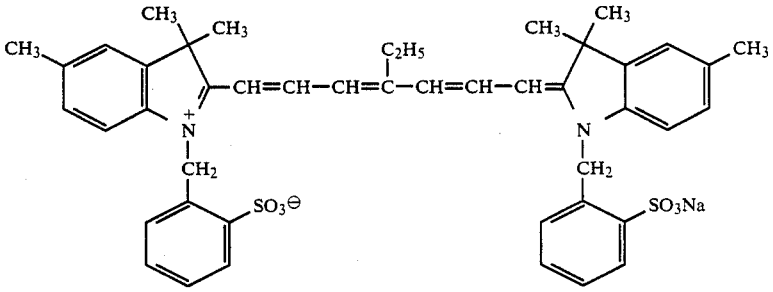

Compound (24)

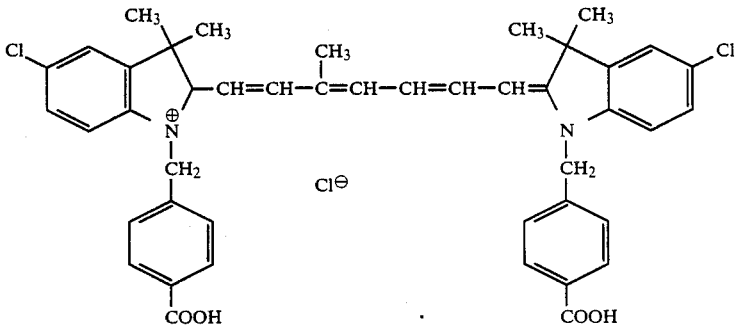

Compound (25)

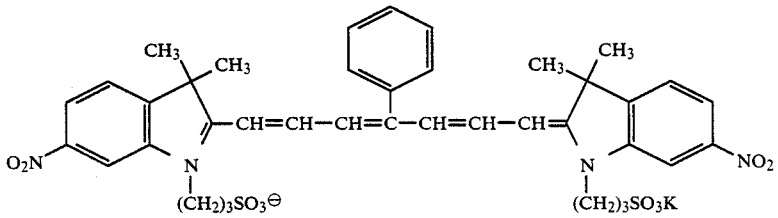

Compound (26)

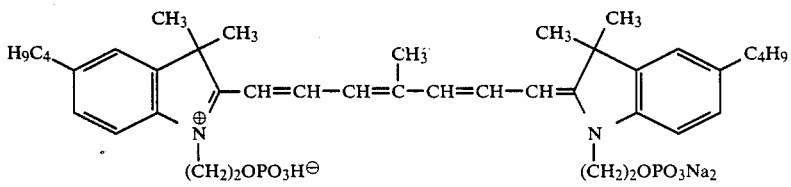

The heptamethine dyes which are used in the invention can be prepared using the conventional methods of preparation. For example, they can be prepared using the method disclosed in Japanese Patent Application (OPI) No. 46245/82. Various other methods are disclosed by F. M. Hamer in *The Cyanine Dyes and Related Compounds,* published by John Wiley and Sons, New York, 1964.

Cyclic anhydrides of organic acids are typical of the cyclic acid anhydrides which are used in the invention. The cyclic anhydride of an organic acid may be a cyclic anhydride of an aliphatic dicarboxylic acid which may be substituted (for example, succinic anhydride, 2-methylsuccinic anhydride, 2-ethylsuccinic anhydride, 2-butylsuccinic anhydride, 2-octylsuccinic anhydride, decylsuccinic anhydride, 2-dodecylsuccinic anhydride, 2-octadecylsuccinic anhydride, maleic anhydride, methylmaleic anhydride, dimethylmaleic anhydride, phenylmaleic anhydride, chloromaleic anhydride, dichloromaleic anhydride, fluoromaleic anhydride, difluoromaleic anhydride, bromomaleic anhydride, itaconic anhydride, citraconic anhydride, glutamic anhydride, adipic anhydride, diglycol anhydride, pimelic anhydride, suberic anhydride, cis-5-norborneneendo-2,3-dicarboxylic acid, d-camphoric anhydride, 3-oxybicyclo[3,2,2]nonane-2,4-dione, 1,3-dioxolan-2,4-dione, etc.); an α-amino acid-N-carboxylic acid anhydride (for example, taking the α-amino acid starting material, glycine, N-phenylglycine, alanine, β-phenylalanine, valine, leucine, isoleucine, α-aminophenylacetic acid, α-aminocaprylic acid, α-aminolauric acid, γ-benzylglutamic acid, sarcosine, etc.); a cyclic aromatic acid anhydride (for example, phthalic anhydride, nitrophthalic anhydride, dinitrophthalic anhydride, methoxyphthalic anhydride, methylphthalic anhydride, chlorophthalic anhydride, cyanophthalic anhydride, dichlorophthalic anhydride, tetrachlorophthalic anhydride, tetrabromophthalic anhydride, 3,3',4,4'-benzophenonetetracarboxylic acid dianhydride, phthalonic anhydride, pyromellitic anhydride, mellitic anhydride, pulvinic anhydride, diphenic anhydride, thiophene dicarboxylic acid anhydride, furan dicarboxylic acid anhydride, 1,8-naphthalene dicarboxylic acid anhydride, pyrrole dicarboxylic acid anhydride, etc.).

Any conventional binding resin can be used in this invention. For example, such resins are disclosed by H. Miyamoto and H. Takei on pages 9 to 12 of *Imaging,* 1973 (No. 8); by D. D. Tatt, S. C. Heidecker in *Tappi,* 49

(10), 439 (1966); by E. S. Baltazzi, R. G. Banchette and R. Minnis in *Photographic Science and Engineering,* 16 (5), 354 (1972) and by Guen Chan Kee, E. Inoue and I. Shimizu in *Journal of the Electrophotographic Society* (Japanese), 18 (2), 28 (1980). In practice, vinyl chloride-vinyl acetate copolymers, styrene-butadiene copolymers, styrene-methacrylate copolymers, polymethacrylates, polyacrylates, acrylic resins, poly(vinyl acetate), poly(alkane acid vinyl esters), poly(vinyl butyral), alkyd resins, modified alkyd resins, silicone resins, polyamide resins, epoxy resins, maleic acid resins, epoxyester resins, polyester resins, etc., can be used for this purpose either individually or conjointly. Furthermore, they can be combined with aqueous acrylic emulsions and acrylic ester emulsions. Furthermore, the numerous.well known methacrylic ester based copolymers which contain carboxyl groups and hydroxyl groups of Japanese Patent Document Nos. 13946/66, 2242/75 and 31011/75 and Japanese Patent Application (OPI) Nos. 54027/78 and 20735/79, etc., can be used as the binding resins for the inorganic photoconductor layers of original plates for lithographic printing (offset masters) in an electrophotographic system.

In general, it is possible to vary the amount of binding resin which is present in a photoconductive composition of this invention. Typically, the useful quantity of resin is within the range from about 10 wt % to about 90 wt % with respect to the total weight of the mixture of photoconductive material and resin. The preferred amount of resin is within the range from about 15 wt % to about 60 wt % with respect to the total amount of photoconductive material and resin.

The sensitizing dyes used in the photoconductive compositions used in the invention are preferred to the conventional red light and infrared radiation sensitizing dyes in that they have much better stability and improved adsorption properties on the above mentioned inorganic photoconductors since at least one carboxyl group, sulfo group or phospho group is contained within the molecule and so the spectral sensitization efficiency is improved. As a result, these dyes provide superior spectral sensitization.

Moreover, the photoconductive compositions used in the invention also contain a cyclic acid anhydride which interacts with the surface of the inorganic photoconductors. As a result of this, it improves the charging characteristics, brings about a marked improvement of the charge-retaining properties of the photoconductors in the dark, and functions in such a way as to enhance sensitizing action of the sensitizing dyes of this invention. Hence, a sulfo group or a phospho group is preferred for the acidic group which is contained in the sensitizing dye to provide a more efficient interaction between the sensitizing dyes, cyclic acid anhydrides and the photoconductor.

Furthermore, methacrylic ester-based resins which contain polar groups such as carboxyl groups or hydroxyl groups which interact strongly with the surfaces of zinc oxide grains are used as the normal binding agents in photosensitive bodies for offset masters in which zinc oxide is used as the inorganic photoconductor. Sensitizing dyes which contain a sulfo group or a phospho group are also preferred in this case.

The sensitizing dyes may be used in any known methods for preparing a photoconductive composition including methods in which a dye solution is added after dispersing the photoconductor in the binding resin, and methods in which the photoconductor is introduced into a dye solution and dispersed in the binding resin after adsorbing dye. The amount of sensitizing dye used in the invention is proportional to the degree of sensitization required and extends over a wide range. Amounts ranging from 0.0005 to 2.0 parts by weight per 100 parts by weight of photoconductor can be used but the amount used is preferably within the range from 0.001 to 1.0 part by weight per 100 parts by weight of the photoconductor.

The cyclic acid anhydride can be used in this invention together with the sensitizing dye in the form of a powder or as a solution. It may be added before the addition of the dye, or the anhydride can be premixed with the photoconductor and followed by the introduction of the binding agent and the dye and dispersion. The method in which the photoconductor and the cyclic acid anhydride are treated beforehand is preferred.

The amount of cyclic acid anhydride used in the present invention can be from 0.0001 to 1.0 part by weight per 100 parts by weight of the photoconductor. If the amount used is below the above range, the effect on the charging characteristics, dark charge-retaining properties and sensitization cannot be obtained. The use of an amount higher than the above range improves the apparent sensitivity but results in a marked decrease in the dark charge-retaining properties.

The sensitizing dyes and cyclic acid anhydrides used in the present invention can be included individually or in combinations of two or more in the photosensitive layer. Furthermore, although the sensitizing dyes of this invention provide spectral sensitization from near infrared to infrared radiation, they can be used conjointly with conventional spectral sensitizing dyes for use in visible light (for example, fluorescein, rose bengal, rhodamine B, monomethine, trimethine and pentamethine type cyanine dyes, merocyanine dyes, etc.) depending on the intended purpose.

Furthermore, various additives conventionally used in electrophotographic photosensitive layers can also be added (for example, the known materials indicated on page 12 of *Imaging,* 1973, (No. 8) by H. Miyamoto and H. Takei). The amounts added are selected such that they do not interfere with the effect of the invention; generally they are added in amounts from 0.0005 to 2.0 parts by weight per 100 parts by weight of photoconductor.

In general, the sensitizing dyes are weakly oxidizing, thus the conjoint use of catalytic compounds which promote oxidation should be avoided. For example, care is required with the use of peroxides such as benzoyl peroxide from among the vinyl polymerization initiators and the organic salts of heavy metals which are used to bring about the curing of unsaturated fatty acids. In this respect similar care must be taken with the sensitizing dyes used in the invention as with conventional sensitizing dyes. There is a difficulty in that with the conventional red light to infrared radiation sensitizing dyes degradation occurs in a short period of time even in systems where oxidation accelerators are not being used conjointly. However, the stability is appreciably improved when a dye of general formula (I) of this invention is used.

The electrophotographic photosensitive layers of this invention can be provided on a conventional support. Electrically conductive supports are generally preferred for electrophotographic photosensitive layers. Metal sheets, plastic films on which an electrically conductive layer has been provided (for example, those which have a thin layer of aluminum, palladium, indium oxide, tin oxide, cuprous iodide, etc.) and paper which has been treated to render it electrically conductive can be used. Polymers which contain quaternary ammonium salts (for example, poly(vinylbenzyltrimethylammonium chloride); the polymers which contain quaternary nitrogen in the main chain as disclosed in U.S. Pat. Nos. 4,108,802, 4,118,231, 4,126,467 and 4,137,217 and the quaternary salt polymer latexes as disclosed in U.S. Pat. No. 4,147,550 and *Research Disclosure,* 16258, etc.); sulfonic acid salts of polystyrene, and colloidal alumina, etc., are well known as agents for treating paper so as to render it electrically conductive. In normal practice, these are often used conjointly with poly(vinyl alcohol), styrene-butadiene latex, gelatin, casein, etc.

Volatile hydrocarbon solvents having boiling points less than 200° C. can be used as organic solvents for dispersion purposes. Halogenated hydrocarbons which have from 1 to 3 carbon atoms, such as dichloromethane, chloroform, 1,2-dichloroethane, tetrachloroethane, dichloropropane or trichloroethane, etc., are preferred. Aromatic hydrocarbons such as chlorobenzene, toluene, xylene or benzene, etc.; ketones such as acetone or 2-butanone, etc.; ethers such as tetrahydrofuran, etc.; various other solvents which can be used for coating compositions such as methylene chloride, etc., and mixtures of these solvents can also be used. The solvent is added at the rate of 1 to 100 g, and preferably 5 to 20 g, per g in total of dye, photoconductive material and other additives.

The coated thickness on an appropriate support of the photoconductive composition of this invention can be varied over a wide range. Normally, it can be coated to a thickness within the range from about 10 μm to about 300 μm (before drying). The preferred range for the coated thickness before drying is within the range from about 50 μm to about 150 μm. However, beneficial effects can be obtained even outside this range. The thickness of the dried coated material may be within the range from about 1 μm to about 50 μm.

The photoconductive compositions used in the invention can be used for the photosensitive layers (photoconductive layers) of an electrophotographic photosensitive material of the single layer type. They may be also used as charge carrier generating layers in electrophotographic photosensitive materials of the separated function type which have two layers, namely a charge carrier generating layer and a charge carrier transporting layer. They may also be used as photoconductive photosensitive particles in photoelectrophoresis electrophotographic methods or for the photoconductive compositions which are used for said methods.

The present invention is further illustrated in greater detail by the following examples, but the present invention is not limited by these examples. Unless indicated otherwise, all parts, percents, ratios and the like are by weight.

EXAMPLE 1

100 Parts of fine particles of zinc oxide (average particle size 0.5 to 1μm, Sazex 2000 ®, made by Sakai Kagaku) was mixed with 0.2 part of phthalic anhydride and this mixture was mixed with 40 parts of a 40 wt % toluene solution of a methyl methacrylate/n-butyl methacrylate/acrylic acid (weight ratio 39.2/58.8/2.0) copolymer, 60 parts of toluene and 10 parts of a methanolic solution of dye containing $1.0\times10^{-3}$ mol/liter of Compound (8) of this invention, and a dispersion was formed by milling these together for 2 hours in a ceramic ball mill. The dispersion was then coated onto an aluminum foil using a wire rod so as to provide a dry film thickness of about 8 μm. An electrophotographic photosensitive body was obtained on drying for 2 hours at 50° C. in a constant temperature vessel.

The photosensitive body was given a coronal charge at 6 kV using a static system, stored in the dark for a period of 60 seconds and then exposed to light, and the charging characteristics were investigated using a paper analyzer (model SP-428, made by Kawaguchi Denki). Thus, the initial charge potential ($V_0$), the extent to which the potential was retained with respect to the initial potential ($V_0$) after reducing in the dark for 60 seconds, which is to say the dark reduction retention (DRR (%)), and the exposure required to reduce the potential to one half after charging to −400 V with a coronal discharge, which is to say the half reduction exposure $E_{\frac{1}{2}}$ (erg/cm$^2$), were measured. A gallium-aluminum-arsenic semiconductor laser (oscillating wavelength 780 nm) was used for the light source. The results were as shown in Table 1.

The optical densities at the peak absorption wavelength in the range from 700 nm to 850 nm of the spectral reflecting powers immediately after manufacture and after storing for 2 weeks under conditions of 50° C., 80% RH were measured for this photosensitive body. The stability was assessed by obtaining the value of the optical density after the accelerated test divided by the optical density immediately after production (the material being more stable as this ratio approaches a value of 1). There was virtually no change to be seen, the value being greater than 0.99, and there was no change in the electrostatic characteristics ($V_0$, DRR, $E_{\frac{1}{2}}$).

COMPARATIVE EXAMPLE 1

A photosensitive body was prepared in exactly the same way as in Example 1 except that the phthalic anhydride was not added in this case. The dark reduction retention and the half reduction exposure were measured in the same way as in Example 1 and the results obtained were as shown in Table 1.

TABLE 1

| Photosensitive Body | $V_0$ (−V) | DRR (%) | $E_{\frac{1}{2}}$ (erg/cm$^2$) |
|---|---|---|---|
| Example 1 | 550 | 91 | 23.1 |
| Comparative Example 1 | 540 | 73 | 80.6 |

It is clear from these results that the combination of a cyclic acid anhydride and a sensitizing dye of this invention provides a greatly improved dark reduction retention and greatly improved sensitivity (corresponding to $E_{\frac{1}{2}}$, a smaller value being better).

EXAMPLES 2 TO 8

Photosensitive bodies were prepared in exactly the same way as in Example 1 except that the dyes shown in Table 2 were used in place of the sensitizing dye (compound (8)) which was used in Example 1. The electrostatic characteristics were measured in the same way as in Example 1 and the results shown in Table 2 were obtained.

TABLE 2

| Example No. | Sensitizing Dye of the Invention | $V_0$ (−v) | DRR (%) | $E_{\frac{1}{2}}$ (erg/cm$^2$) |
|---|---|---|---|---|
| 2 | Compound (1) | 550 | 93 | 20.0 |

TABLE 2-continued

| Example No. | Sensitizing Dye of the Invention | $V_0$ (−v) | DRR (%) | $E_{\frac{1}{2}}$ (erg/cm$^2$) |
|---|---|---|---|---|
| 3 | Compound (2) | 555 | 90 | 19.8 |
| 4 | Compound (4) | 550 | 90.5 | 21.2 |
| 5 | Compound (5) | 550 | 91.1 | 20.5 |
| 6 | Compound (6) | 545 | 89 | 26.8 |
| 7 | Compound (7) | 560 | 88 | 30.0 |
| 8 | Compound (9) | 555 | 90 | 23.2 |
| 9 | Compound (10) | 540 | 85 | 24.1 |
| 10 | Compound (11) | 550 | 90 | 20.3 |
| 11 | Compound (12) | 550 | 91.5 | 21.4 |
| 12 | Compound (13) | 555 | 89 | 24.7 |
| 13 | Compound (14) | 550 | 90 | 35.0 |
| 14 | Compound (15) | 545 | 91 | 31.6 |
| 15 | Compound (16) | 550 | 89 | 28.5 |
| 16 | Compound (17) | 540 | 91 | 25.5 |
| 17 | Compound (20) | 550 | 88 | 26.1 |
| 18 | Compound (21) | 545 | 90 | 36.5 |

Furthermore, the electrostatic characteristics of these photosensitive bodies were measured again after storage for 2 weeks under conditions of 50° C., 80% RH but there was no real difference from the results obtained prior to storage under these conditions.

It is clear from these results that the photoconductive compositions of this invention are stable even under rigorous conditions, and that they have markedly superior dark charge-retaining properties and photosensitivity as compared to the prior art photoconductive compositions.

EXAMPLES 19 TO 30

Photosensitive bodies were prepared in exactly the same way as in Example 1 except for the conditions indicated below and the electrosrostatic properties were measured. The results obtained were as shown in Table 3.

In this case the amount of phthalic anhydride and the compounds shown in Table 3 added was $7\times10^{-4}$ mol per 100 parts by weight of zinc oxide.

Furthermore, the electrostatic characteristics of these photosensitive bodies were measured again after storage for 2 weeks under conditions of 50° C., 80% RH but there was virtually no change from the values observed prior to storage under these conditions.

It is clear from these results that the photoconductive compositions of this invention are stable even under rigorous conditions and that they have markedly superior dark charge-retaining properties and photosensitivity as compared to the prior art photoconductive compositions.

TABLE 3

| Example No. | Cyclic Acid Anhydride of the Invention | $V_0$ (−V) | DRR (%) | $E_{\frac{1}{2}}$ (erg/cm$^2$) |
|---|---|---|---|---|
| 19 | Phthalic anhydride | 550 | 91 | 60 |
| 20 | o-Sulfobenzoic anhydride | 550 | 90 | 59 |
| 21 | 4-Nitrophthalic anhydride | 555 | 92 | 60 |
| 22 | Pyromellitic anhydride | 550 | 95 | 40.5 |
| 23 | Mellitic anhydride | 555 | 92 | 53 |
| 24 | Citraconic anhydride | 550 | 85 | 64 |
| 25 | 1,8-Naphthalenedi-carboxylic acid anhydride | 555 | 90 | 68 |
| 26 | 3,3',4,4'-benzo-phenonetetra-carboxylic acid anhydride | 550 | 89 | 65 |
| 27 | Maleic anhydride | 550 | 85 | 66 |
| 28 | Cis-5-norbornene-endo-2,3-dicarboxylic acid anhydride | 550 | 86 | 65 |
| 29 | 3,4-Thiophenedicarboxylic acid anhydride | 550 | 85 | 65 |
| 30 | Dichloromaleic anhydride | 550 | 86 | 64 |

While the invention has been described in detail and with reference to specific embodiments thereof, it will be apparent to one skilled in the art that various changes and modifications can be made therein without departing from the spirit and scope thereof.

What is claimed is:

1. A method of electrographic image formation which comprises exposing a photosensitive body comprising a photoconductive composition to a scanning laser beam and developing the exposed photosensitive body, wherein said photoconductive composition comprises at least an inorganic photoconductor, a spectral sensitizing dye and a cyclic acid anhydride dispersed in a binding resin, said cyclic acid anhydride being present in an amount of from 0.0001 to 1.0 part by weight per 100 parts by weight of said photoconductor, wherein said dye is a compound containing at least one carboxyl group, sulfo group and/or phospho group and is represented by formula (1),

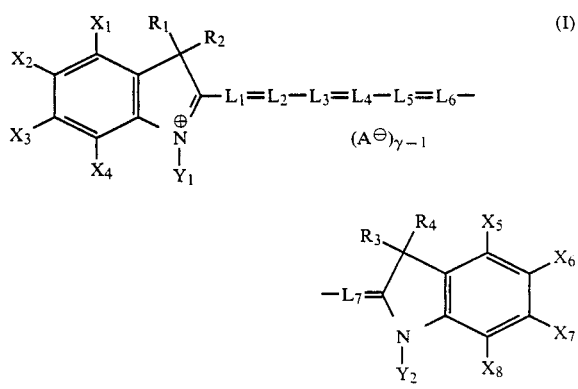

(I)

wherein $R_1$, $R_2$, $R_3$ and $R_4$ may be the same or different and each represents an alkyl group, wherein $L_1$ to $L_7$ may be the same or different each is a substituted or unsubstituted methine group, wherein $X_1$ to $X_8$ may be the same or different and each is a hydrogen atom; a carboxyl group; a sulfo group; a halogen atom; a nitro group; a cyano group; a substituted or unsubstituted alkyl group; a substituted or unsubstituted aralkyl group; a substituted or unsubstituted aryl group; an $OZ_1$, —O-$COZ_2$ or —$COOZ_3$ group wherein $Z_1$, $Z_2$ and $Z_3$ may be the same or different and each represents a substituted or unsubstituted aliphatic group, a substituted or unsubstituted aromatic group or a substituted or unsubstituted heterocyclic group; a

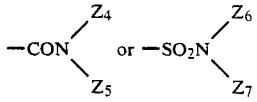

group wherein $Z_4$, $Z_5$, $Z_6$ and $Z_7$ may be the same or different and each represents a hydrogen atom, a substituted or unsubstituted aliphatic group, a substituted or unsubstituted aromatic group, or $Z_4$, $Z_5$ or $Z_6$ and $Z_7$ together, with the adjacent atom, N, form a heterocyclic group, with the further proviso that $X_5$ and $X_6$ may be connected to each other to form a benzene ring, with the even further proviso that at least one of $X_1$ to $X_8$ represents a group other than a hydrogen atom;

wherein $Y_1$ and $Y_2$ may be the same or different and each is a substituted or unsubstituted alkyl group;

$A^{\ominus}$ represents an anion;

$\gamma$ represents 1 or 2, further providing that when $Y_1$ and/or $Y_2$ contains a sulfo or phospho group, $\gamma$ is 1.

2. A method according to claim 1, wherein the amount of spectral sensitizing dye present in said composition is from 0.0005 to 2.0 parts by weight per 100 parts by weight of the photoconductor.

3. A method according to claim 2, wherein said amount of dye is from 0.001 to 1.0 part by weight per 100 parts by weight of the photoconductor.

4. A method according to claim 1, wherein said cyclic acid anhydride is at least one member selected from the group consisting of a cyclic anhydride of an aliphatic dicarboxylic acid, an α-amino acid-N-carboxylic acid anhydride and a cyclic aromatic acid anhydride.

5. A method according to claim 1, wherein said inorganic photoconductor is one selected from the group consisting of zinc oxide, titanium oxide, zinc sulfide, cadmium sulfide, zinc selenide, cadmium selenide and lead sulfide.

6. A method according to claim 1, wherein said spectrosensitizing dye represented by formula (I) contains at least two groups selected from the carboxylic, sulfo and phospho groups.

7. A method according to claim 1, wherein said dye represented by general formula (I) contains at least two sulfo groups.

8. A method according to claim 1, wherein said dye represented by general formula (I) contains at least one sulfo group or phospho group.

9. A method according to claim 1, wherein the acidic group contained in the sensitizing dye is a sulfo group or a phospho group.

* * * * *